United States Patent [19]

Stephenson

[11] 4,115,941

[45] Sep. 26, 1978

[54] DISPLAY AND RESET APPARATUS

[75] Inventor: Lorne Stephenson, Spokane, Wash.

[73] Assignee: American Sign & Indicator Corporation, Spokane, Wash.

[21] Appl. No.: 774,887

[22] Filed: Mar. 7, 1977

[51] Int. Cl.[2] ..... G09F 9/30

[52] U.S. Cl. ..... 40/452; 40/466; 340/324 R; 340/378 R

[58] Field of Search ..... 40/28 C, 52 R, 32, 61 A, 40/447, 449, 459, 450, 454, 472, 487, 452; 340/336, 324 R, 378 R; 178/17.5

[56] References Cited

U.S. PATENT DOCUMENTS

| | | | |
|---|---|---|---|
| 3,199,098 | 8/1965 | Schwartz | 40/28 C |
| 3,562,938 | 2/1971 | Salam | 40/52 RX |
| 3,624,647 | 11/1971 | Smith | 340/324 RX |

*Primary Examiner*—John F. Pitrelli
*Assistant Examiner*—G. Lee Skillington
*Attorney, Agent, or Firm*—Wells, St. John & Roberts

[57] ABSTRACT

A display sign of the type comprising a back-lighted panel having a plurality of discrete light-transmitting areas and an equal number of controlled opaque disks which move between alternate stable positions. One position of each disk overlies the light-transmitting area associated therewith. The other position of each disk is offset to one corresponding side of its associated light-transmitting area. The disks are operated by electromagnets or other noncontacting means mounted to a carriage rearward of the panel. Selected disks are shifted from one position to the other during relative movement between the carriage and panel. The improvement comprises a magnetic drum which precedes the electromagnets to momentarily reset all of the disks in their first position overlying the individual light-transmitting area associated therewith in a progressive pattern just forward of the disks being set by the electromagnets.

5 Claims, 4 Drawing Figures

DISPLAY AND RESET APPARATUS

BACKGROUND OF THE INVENTION

This invention relates to information displays of the general type illustrated in U.S. Pat. No. 3,562,938 to Salam granted Feb. 16, 1971. Such displays comprise a panel having a plurality of discrete light-transmitting areas arranged along transversely spaced upright columns and surrounded by a background which is preferably, but not essentially, opaque. The panel is normally backlighted and the desired display is viewed as light transmitted through the discrete areas. Circular disks are mounted for planar movement between the panel and a backing member. Each disk is individually movable between alternate stable positions, namely a first position in which the disk overlies the light-transmitting area associated thereto, and a transversely adjacent second position wherein it is clear of the light-transmitting area and to one corresponding side thereof. By arranging selected disks in one or the other of such positions, may desired lighted pattern can be achieved through the numerous light-transmitting areas, thereby producing the desired visual pattern on the viewed panel.

As described in U.S. Pat. No. 3,562,938, one method for controlling the disks is by use of a row of electromagnets arranged along an upright carriage which spans the height of the light-transmitting areas on the panel. Relative movement between the carriage and panel causes the panel to be swept in one direction across the width of the panel, thereby overlapping the respective first and second positions of each disk in a repetitive progression. By timing the activation of the individual electromagnets relative to such movement, each disk can be momentarily moved in relation to the panel or left stationary.

To use such a carriage to arrange the disks in a desired pattern, it is first necessary that every disk be in a known position before being encountered by the electromagnetic forces which control the display. According to the disclosure in U.S. Pat. No. 3,562,938, this is achieved by traversing the panel with all of the electromagnets in an energized state. This will draw all of the disks to a corresponding position. This is accomplished during return movement of the carriage in a direction opposite to the carriage movement when arranging the disks in a display.

Presetting the disks during return movement of the carriage has operational drawbacks. Most importantly, the proper magnetic coupling of the disks to the electromagnets on the carriage necessitates that the rate of speed of the carriage relative to the panel be limited. Excess speed might result in some disks not being reset. From a visual standpoint, such presetting requires that the lighted display be gradually blanked from one side to the other so that there is a progressive deactivation of the display. During this time, the portions of the display which have been reset are obviously not usable for communication purposes. In a constantly changing display, such as an airline schedule board, this full panel reset process requires a substantial percentage of the total time of display utilization. Since one advantage of the type of display to which this disclosure relates is its versatility and ability to be rapidly changed, the relatively slow full panel reset function is a negative operational function.

The present improvement was devised in an attempt to minimize the time required to reset the disks and substitute an alternative display on the panel. This is accomplished by doing both functions almost simultaneously in a rapid progression as the carriage moves in one direction across the panel.

SUMMARY OF THE INVENTION

The present improvement comprises a disk operating means positioned on the carriage so as to lead the electromagnets during each operational sweep of the panel by the carriage. The disk operating means is operable to preset each disk in one of its alternate positions prior to its operative encounter by the electromagnets which arrange the disks in the desired display pattern. More specifically, the improvement comprises a magnetic drum on the carriage alongside the electromagnets for rotation about a drum axis parallel to the row of electromagnets that set the display. The drum is located on the carriage so as to precede the electromagnets as the carriage sweeps across the panel in one direction of movement. The drum is powered to rotate about its axis such that the direction of the tangential component of the velocity at the point of the drum nearest the panel is opposite to the direction of movement of the carriage. The magnetic drum thereby moves every disk in a direction opposite to the carriage movement so that the disks are reset for encounter by the moving, individually controlled electromagnets.

It is a first object of this invention to provide a carriage mechanism which simultaneously resets the disks to a chosen alternate position during the same operational sequence in which the selected disks are moved to display a chosen pattern on the panel.

Other objects will be evident from the following disclosure and the accompanying drawings which illustrate a preferred form of the invention.

DESCRIPTION OF THE PREFERRED EMBODIMENT

Figure 1:
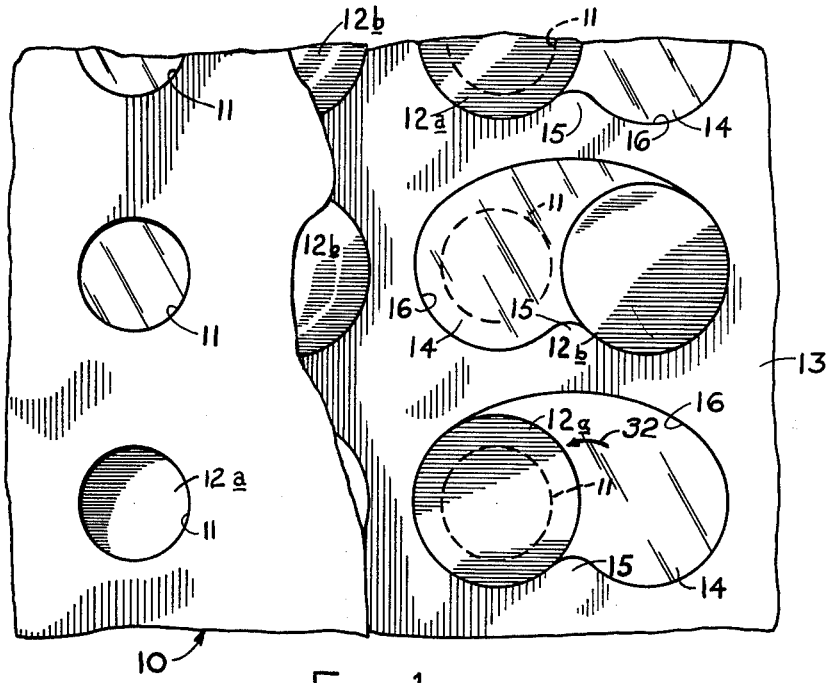
FIG. 1 is an enlarged fragmentary front view of the basic display components.

As shown in the drawings, this disclosure relates to a display sign comprising an upright back-lighted panel 10 having a plurality of discrete light-transmitting areas 11 arranged along transversely spaced upright columns and intersecting transverse lines. While the drawings illustrate the columns as being vertical and the lines as being horizontal, this is not a necessary limitation to the application of the disclosure, since they might be arranged along oblique rows forming angles to either the vertical or horizontal or both. Similarly, while the panel 10 is normally operated in a vertical position, it can be arranged in other upright positions tilted forward or backward slightly from the vertical when desired.

Immediately rearward of the panel 10 are located a plurality of circular disks 12 individually movable between alternate stable positions, namely a first position in which the disk overlies its associated light-transmitting area, and a second position in which it is clear thereof. The number of disks 12 arranged about a panel is equal in number to the number of light-transmitting areas 11 on the panel. Each disk 12 is made of ferromagnetic material or a material capable of accepting an electrostatic charge, depending upon the type of force to be applied to the disks. Each disk has a diameter capable of overlying an associated light-transmitting area 11. A backing member 14 is fixedly spaced parallel to the panel 10 and the disks 12 are individually mounted within the space separating the panel 10 and backing member 14. Each disk 12 is preferably located within a hollow cell 16 intersected at one corresponding side by one light-transmitting area 11 on panel 10. The individual cells 16 are formed within an intermediate layer 13 fixed between panel 10 and backing member 14.

The disks 12 are mounted loosely behind panel 10 and are shifted in a coplanar movement between their alternate positions. This is accomplished by noncontacting means for exerting force on the disks 12, such as electromagnets or by electrostatic attraction or repulsion. Disks 12 are normally opaque, although they can be translucent. Each cell 16 normally has an intermediate projection 15 at the center of its lower surface, it being necessary for the disk 12 to move upwardly across the projection 15 to move from one side of cell 16 to the other. The projections 15 assist in defining the two alternate stable positions for each disk 12 by preventing it from accidently rolling from one side of cell 16 to the other.

A general description of the display device is found in U.S. Pat. No. 3,562,938 to Salam, which is hereby incorporated by reference.

Each disk 12 is moved in a planar fashion during setting of the display. It must be shifted from a first position (illustrated by disk 12*a* in FIG. 1) wherein it overlies a light-transmitting area 11 in the panel 10 to a second position (illustrated by disk 12*b* in FIG. 1) where it is clear of the light-transmitting area 11 and is behind the background area about panel 10. The two positions of each disk are identical about the panel 10, the second position of each disk 12 being to one corresponding side of its first position. As described in U.S. Pat. 3,562,938, the disks are set by a row of electromagnets 17 mounted to a carriage 18 which sweeps across the panel in one direction, each electromagnet 17 being individually activated in a timed sequence with respect to the positions of the cells 16 so as to exert a moving force on selected disks 12 to move them in the direction of relative movement of carriage 18 with respect to panel 10. Before setting the display, the carriage 18 is moved in a return direction with all of the electromagnets 17 activated, thereby assuring that every disk 12 is in its first position due to the forces exerted on the individual disks by the moving electromagnets. As discussed above, this has serious operational drawbacks because of the time required to move carriage 18 across the full width of panel 10 so as to move all of the disks 12 to one position before setting a desired display on panel 10.

While this disclosure specifically describes a display system in which the disks 12 are reset to a position overlying the light-transmitting areas 11, it is to be understood that the cells 16 could be reversed so that the reset disks 12 would be clear of the light-transmitting areas 11. Furthermore, while it is generally advisable in arranging displays containing written material to set the display while moving the carriage from left to right as viewed from the front of the panel 10, a display can be arranged on panel 10 while moving the carriage from right to left. With the present invention it is also possible to arrange displays alternately while moving the carriage from left to right and then from right to left, with no return sweep of the carriage 18 being necessary.

Carriage 18 comprises a movable framework capable of traversing the width of panel 10 in a linear or translational movement. It can be supported by cables, rollers, or other guiding devices on a fixed frame (not shown) that provides stationary support for panel 10. While carriage 18 is illustrated as being movable relative to panel 10, it is also practical to maintain the carriage 18 in a stationary position and move panel 10 with respect to it. In any respect, there is provided translational relative movement between carriage 18 and panel 10.

Figure 2:
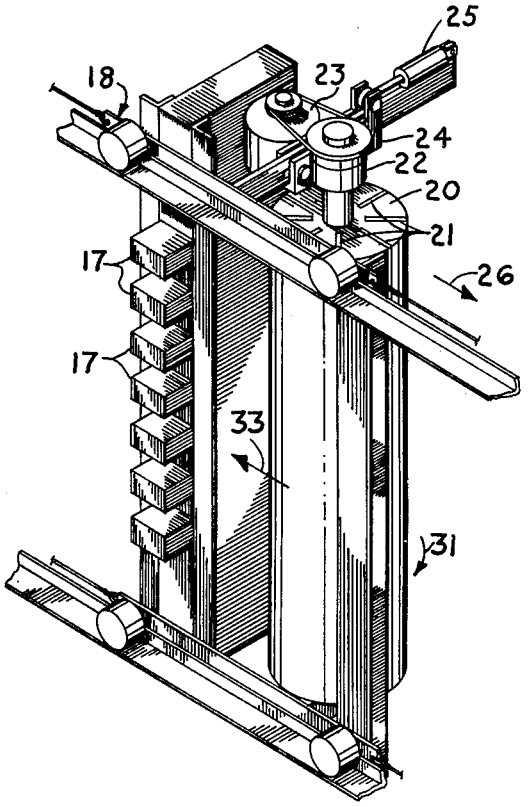
FIG. 2 is a fragmentary diagrammatic perspective view of the improvement.
Figure 4:
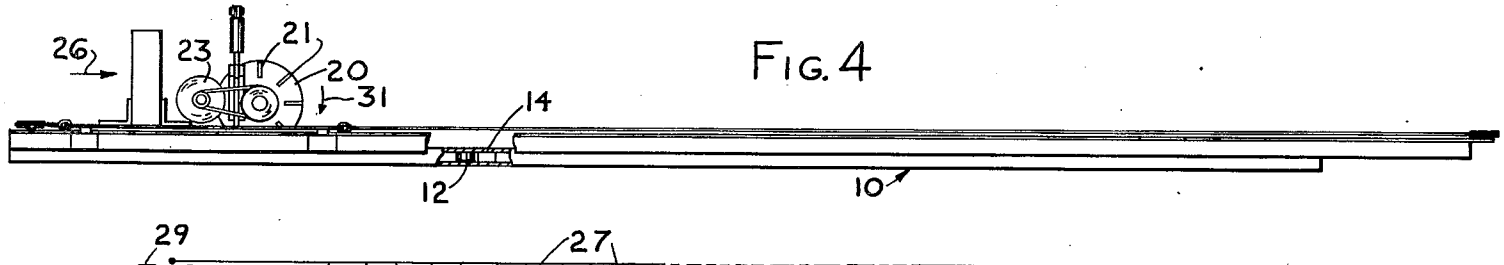
FIG. 4 is a diagrammatic top view of the improvement.
Figure 3:
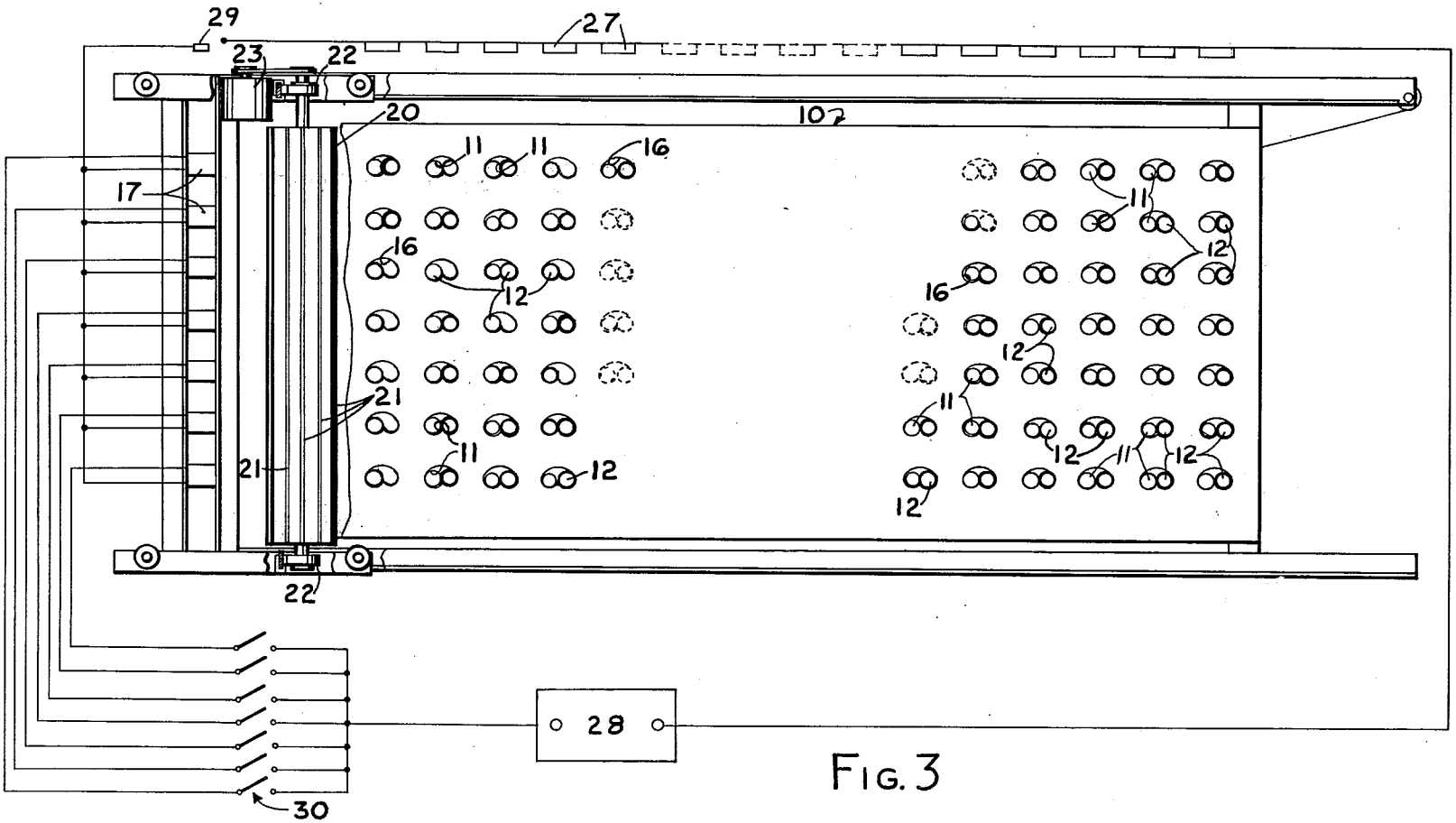
FIG. 3 is a fragmentary diagrammatic frontal view of the improvement.

The present improvement adds a new reset device to the above-described basic apparatus. This reset device is illustrated in FIGS. 2, 3 and 4 as being an upright drum 20 rotatably mounted on carriage 18 about an upright central drum axis parallel to the row of electromagnets 17. Drum 20 is transversely adjacent to one side of electromagnets 17. Its periphery facing toward the backing member 14 is substantially coplanar to the forwardly facing surfaces of electromagnets 17.

As illustrated, drum 20 is comprised of a plurality of permanent bar magnets arranged in opposite polarities, so that the north pole of one magnet is interposed between the two south poles of the magnets at each side of it. The magnets are generally illustrated at 21. The upright length of drum 20 and magnets 21 spans the height of one upright column of light-transmitting areas 11 on panel 10, so as to be operative with respect to a full column of disks 12. While individual magnetic areas might be utilized along drum 20 to operate upon the individual lines of light-transmitting areas 11, since drum 20 is used to reset all of the disks 12, common upright magnets are practical in this application. Magnets 21 can either be permanent bar magnets or other types of permanent magnets, or may be electromagnets. Other types of magnetic drum configurations might be used. In an electrostatic device, the drum 20 would be provided with a source of electrostatic potential.

Drum 20 is supported on end bearings 22 and is rotatably driven by a motor 23 mounted to carriage 18. Other means for rotating drum 20 can be provided, either by incorporating an independent motor to drive the drum or by mechanically turning drum 20 in direct relation to relative movement between carriage 18 and panel 10. The bearings 22 are movable in a reciprocating fashion on slide mounts 24 located at the upper and lower ends of carriage 18. Bearings 22 are moved by small cylinders 25 or by other power operating devices. Their purpose is to retract the drum 20 in a direction perpendicular to panel 10, so as to move the magnets 21 sufficiently rearward from backing member 14 so as to selectively interrupt the magnetic coupling between drum 20 and disks 12. Drum 20 is therefore positionable either in an extended position adjacent to backing member 14, where the magnets 21 exert force on the disks 12, or in a retracted position where no such force is exerted by the permanent magnets. Drum 20 can also be rendered operative or inoperative by electrical switching in the case of a drum having electromagnets incorporated therein.

While only a single drum 20 is shown to one side of the electromagnets 17, it is to be understood that an identical drum assembly might be provided at each side of electromagnets 17 in the case of a carriage 18 designed to set the disks 12 in a desired display when moving back and forth in opposite directions of travel across panel 10. The illustrated arrangement is used in setting disks 12 while moving only in one direction across panel 10. Electromagnets 17 and drum 20 are inoperative during return movement of carriage 18 to its starting position.

The operation of the device can best be understood from FIGS. 2 through 4. As shown, the panel 10 is stationary and the carriage 18 moves from a starting position at the left end of the panel in a direction of movement indicated by arrow 26. As the carriage 18 sweeps across panel 10, the electromagnets 17 are individually operated in a timed sequence to either move the disks 12 from their first position to the second position, or to leave the disks 12 in their first position, depending upon the desired pattern necessary about panel 10 for a particular visual display. Timing is accomplished in the illustrated schematic arrangement by interrupted conductors 27 along the panel 10 which complete the electrical circuit through contact 29 on carriage 18 from a power source 28 to the individual electromagnets 17 when the electromagnets 17 are operated by switching means shown generally at 30. While illustrated as individual switches, the switching means 30 in actual practice might comprise solid state switching devices arranged in logic circuitry which can be controlled by a manual keyboard, or by a programmed computer.

Drum 20 precedes electromagnets 17 and is rotated by the motor 23 or other source or power. The drum is powered to rotate about its axis such that the direction of the tangential component of the velocity at the point of the drum nearest the panel (see arrows 33) is opposite to the direction of movement of the carriage (illustrated by arrow 26). See FIG. 2. In other words, while carriage 18 is moved from left to right across the stationary panel 10, the resultant relative movement of the drum surface facing the panel 10 is from right to left, as indicated at 33. This drum movement assures magnetic coupling between the magnets 21 and the disks 12. The force exerted on each disk 12 shifts it within the cell 16 in a direction from right to left as viewed from the front of the panel 10. This direction of movement of disk 12 is shown by arrow 32 in FIG. 1.

As the rotating drum 20 traverses each cell 16, it assures that the disk 12 in that cell is returned to its first position covering the light-transmitting area 11 associated with that cell. Naturally if the disk 12 were in its first position when encountered by the force from drum 20, it would remain stationary. In any respect, the functional operation of drum 20 is to erase the previous display and arrange all of the disks 12 in a known position so that they can be selectively shifted by the following action of electromagnets 17. In this manner, the resetting of all disks 12 and subsequent selection of a new display is accomplished during one continuous movement of carriage 18 in a sweeping fashion across the width of panel 10.

After the new display has been set on panel 10 and carriage 18 has reached its right hand limit of travel, the drum 20 can be selectively deactivated or rendered inoperative by retracting drum 20 relative to panel 10. The electromagnets 17 are also deactivated by the controls associated with them, and carriage 18 can then return to its starting position at the left side of panel 10 without disturbing the display arranged on panel 10.

In general, this arrangement uses first and second disk operating devices to exert inductive noncontacting forces on each disk 12 encountered thereby. In order to achieve resetting and setting of the disks 12 in one movement of carriage 18, it is necessary that there be relative movement between the carriage 18 and one of the disk operating devices. In the above description, this relative movement is provided between the resetting drum and the carriage. However, it is to be understood that the electromagnets or other devices used to set the disks might be movably mounted on the carriage for relative movement with respect to the panel opposite to the direction of carriage movement. In this case the resetting electromagnets or other devices could be mounted in stationary positions on the carriage. In either case, one of the two disk operating means must have a resultant direction of movement relative to panel 10 opposite in direction to the direction of movement of carriage 18 relative to the panel.

The above description has been concerned with the general arrangement of a resetting apparatus immediately adjacent the electromagnets or other noncontacting devices which set the display on this particular type of panel. Various modifications can obviously be made with respect to the operational elements generally described, and the disclosure is not intended to be limited to these features in detail.

Having thus described my invention, I claim:

1. In an information display device having:

an upright panel with a plurality of discrete light-transmitting areas arranged along transversely spaced upright columns and surrounded by a background;

a backing member spaced parallel to the panel;

a plurality of circular disks equal in number to the number of light-transmitting areas on the panel, each disk having a diameter capable of overlying an associated light-transmitting area;

means individually mounting each disk within the space separating said panel and said backing member for selective coplanar movement between alternate stable positions in relation to its associated light-transmitting area, namely a first position in which the disk overlies its associated light-transmitting area, and a second position in which it is clear thereof;

and carriage means mounted rearward of the backing member for permitting relative movement between the panel and said carriage means in a continuous sweep;

the improvement comprising:

first and second disk operating means on said carriage means for sequentially exerting inductive forces on each disk operatively encountered thereby during a continuous sweep of the panel relative to said carriage means;

said first disk operating means being positioned on said carriage means relative to the position of said second disk operating means so as to lead said second disk operating means during each sweep of the panel, said first disk operating means being operable to preset each disk in one of said alternate positions prior to its operative encounter by said second disk operating means;

said second disk operating means being operable to move selected individual disks operatively encountered thereby from said one position to their remaining alternate positions one of said disk operating means comprising a column of disk operators in fixed positions on the carriage means;

the remaining one of said disk operating means comprising a drum rotatably mounted to said carriage means about an axis parallel to said column of disk operators.

2. An information display device as set out in claim 1; wherein said second disk operating means comprises a column of individually operable electromagnets spaced along such column of light-transmitting areas in positions corresponding to the positions of the light-transmitting areas in a single upright column;

said first disk operating means comprising a magnetic drum, the height and elevational position of the drum corresponding to the height and elevational position of a single upright row of light-transmitting areas on the panel;

means on said carriage means operatively connected to said drum for rotating said drum about its axis in a direction such that the direction of the tangential component of the velocity of the drum periphery nearest the panel is opposite to the direction of movement of the carriage means relative to the panel;

and means for disabling the magnetic drum following each sweep of the panel to permit reversal of the relative movement between said carriage means and said panel without operative encounter of the disks by said drum.

3. In an information display device having:

an upright panel with a plurality of discrete light-transmitting areas arranged along transversely spaced upright columns and surrounded by a background;

a backing member spaced parallel to the panel;

a plurality of circular ferromagnetic disks equal in number to the number of light-transmitting areas on the panel, each disk having a diameter capable of overlying an associated light-transmitting area;

means individually mounting each disk within the space separating said panel and said backing member for coplanar movement between alternate stable positions in relation to its associated light-transmitting area, namely a first position in which the disk overlies the light-transmitting area, and a transversely adjacent second position wherein it is clear of the light-transmitting area and to one corresponding side thereof;

and carriage means mounted rearwardly adjacent the backing member for permitting relative movement between the panel and said carriage means in a continuous sweep in a direction transverse to the upright columns;

the improvement comprising:

first and second disk operating means on said carriage means for sequentially exerting inductive forces on each disk operatively encountered thereby during a continuous sweep of the panel relative to said carriage means;

said first disk operating means being positioned on said carriage means relative to the position of said second disk operating means so as to lead said second disk operating means during each sweep of the panel, said first disk operating means being operable to preset each disk in said first position prior to its operative encounter by said second disk operating means;

said second disk operating means being operable to move a selected individual disk operatively encountered thereby from said first position to said second position one of said disk operating means comprising a column of electromagnets in fixed positions on the carriage means;

the remaining one of said disk operating means comprising a magnetic drum rotatably mounted to said carriage means about an axis parallel to said column of electromagnets.

4. An information display device as set out in claim 3 further comprising:

means on said carriage means operatively connected to said drum for rotating said drum about its axis in a direction such that the direction of the tangential component of the velocity of the drum periphery facing nearest the panel is opposite to the direction of movement of the carriage means relative to the panel.

5. In an information display device having:

an upright panel with a plurality of discrete light-transmitting areas arranged along transversely spaced upright columns and surrounded by a background;

a backing member spaced parallel to the panel;

a plurality of circular ferromagnetic disks equal in number to the number of light-transmitting areas on the panel, each disk having a diameter capable of overlying an associated light-transmitting area;

means individually mounting each disk within the space separating said panel and said backing member for coplanar movement between alternate stable positions in relation to its associated light-transmitting area, namely a first position in which the disk overlies the light-transmitting area and a transversely adjacent second position wherein it is clear of the light-transmitting area and to one corresponding side thereof;

an upright carriage movably mounted rearwardly of the backing member, said carriage spanning the height of each column of light-transmitting areas;

means operatively connected to said carriage for imparting thereto translational movement relative to the panel overlapping the respective first and second positions of each disk in a repetitive progression as it sweeps across the panel in one direction of movement;

and selectively operable magnetic means mounted on said carriage for sequentially exerting inductive forces on selected disks during movement of the carriage for moving such disks from their first positions to their second positions;

the improvement comprising:

a magnetic drum mounted on said carriage alongside said magnetic means for rotation about a drum axis parallel to said magnetic means, said magnetic drum being located on said carriage so as to precede said magnetic means as the carriage sweeps across the panel in said one direction of movement;

and means operatively connected to said magnetic drum for rotating it about said drum axis at a rotational direction and velocity such that the direction of the tangential component of the velocity of the drum nearest the backing member is in a direction opposite to said one direction.

* * * * *